US006514053B2

(12) United States Patent
Takura et al.

(10) Patent No.: US 6,514,053 B2
(45) Date of Patent: Feb. 4, 2003

(54) MOTOR-DRIVEN PUMP WITH A PLURALITY OF IMPELLERS

(75) Inventors: Toshiyasu Takura, Hino (JP); Yoshifumi Tanabe, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/777,436

(22) Filed: Feb. 6, 2001

(65) Prior Publication Data

US 2001/0014290 A1 Aug. 16, 2001

(30) Foreign Application Priority Data

Feb. 10, 2000 (JP) ..... 2000-033527
Dec. 14, 2000 (JP) ..... 2000-380350

(51) Int. Cl.[7] ..... F04B 35/00

(52) U.S. Cl. ..... 417/371; 417/352; 417/371; 417/423.5; 415/102

(58) Field of Search ..... 417/350, 352, 417/353, 355, 371, 423.1, 423.3, 423.5, 423.7, 423.8; 415/102, 206

(56) References Cited

U.S. PATENT DOCUMENTS 1,908,427 A * 5/1933 Jennings ..... 417/423.1
2,341,871 A * 2/1944 Karrer ..... 415/204
2,999,628 A * 9/1961 Crombie ..... 415/99
3,022,739 A * 2/1962 Herrick et al. ..... 417/369
3,269,322 A * 8/1966 Lotspih ..... 417/423.3
3,467,602 A * 9/1969 Wilson ..... 416/20 R
4,530,639 A * 7/1985 Mowill ..... 415/102
4,563,124 A * 1/1986 Eskew ..... 415/102
4,990,068 A * 2/1991 Zhong et al. ..... 417/423.7
5,352,088 A 10/1994 Arbeus
5,692,886 A * 12/1997 Kobayashi et al. ..... 417/423.1
6,109,887 A * 8/2000 Takura et al. ..... 417/237.7

FOREIGN PATENT DOCUMENTS

JP 58-8295 1/1983
JP 11230088 A * 8/1990

OTHER PUBLICATIONS

Toshiba TEC Corporation (TTEC), Feb. 23, 2002, Toshiba-tec, News Release, 5 pages.*

* cited by examiner

*Primary Examiner*—Charles G. Freay
*Assistant Examiner*—John Belena
(74) *Attorney, Agent, or Firm*—Frishauf, Holtz, Goodman & Chick, P.C.

(57) ABSTRACT

A motor-driven pump with a plurality of impellers, includes a pump housing provided on an electric motor, and an impeller unit provided in an inner space of the housing, the housing having two fluid inlet port regions on two sides near and away from the motor in a longitudinal direction of an output shaft of the motor, and having one fluid discharge port region between the inlet port regions, and the unit including a pair of impellers having a partition wall fixed to the output shaft, directing to the discharge port region, and partitioning the inner space into two portions near and away from the motor, and a pair of blade groups provided on both sides of the partition wall.

29 Claims, 7 Drawing Sheets

MOTOR-DRIVEN PUMP WITH A PLURALITY OF IMPELLERS

CROSS-REFERENCE TO RELATED APPLICATIONS

This application is based upon and claims the benefit of priority from the prior Japanese Patent Applications No. 2000-033527, filed Feb. 10, 2000; and No. 2000-380350, filed Dec. 14, 2000, the entire contents of which are incorporated herein by reference.

BACKGROUND OF THE INVENTION

The present invention relates to a motor-driven pump with a plurality of impellers.

A motor-driven pump of this type is used to increase a discharge amount of fluid discharged therefrom and known from, for example, Japanese Patent Application KOKAI Publication No. 58-8295.

The motor driven pump described in the Publication No. 58-8295 comprises an electric motor and a pump unit having a rotational center shaft coupled to the output shaft of the electric motor. Both end portions of the rotational center shaft of the pump unit are rotatably supported by both side walls of a pump housing through a pair of bearings, and a pair of impellers are fixed to a central portion of the center shaft in its longitudinal direction. The paired impellers have a pair of fluid inlet regions opening toward the both end portions of the central shaft from the neighborhood of the longitudinal center portion of the rotational center shaft in an inner space of the pump housing, and one fluid discharge region opening outward in a radial direction of the rotational center shaft from the neighborhood of the central portion. Namely, in the paired impellers, a pair of fluid channels from the paired fluid inlet regions toward the one fluid discharge region are joined together in the vicinity of the fluid discharge region. In the pump housing, a spiral shaped chamber is formed in a portion facing the fluid discharge region of the paired impellers. An outlet of the spiral shaped chamber is connected to a conduit, not shown, and a distal end of this conduit reaches a position to which fluid is to be moved by this motor-driven pump. In addition, in the inner space of the pump housing, fluid to be moved by this motor-driven pump is flowed into on the both side portions of the paired impellers through conduits not shown.

In case of the conventional motor-driven pump described above, when the rotational center shaft is rotated in a predetermined direction by the output shaft of the motor, the fluid in the paired fluid inlet regions of the paired impellers are given kinetic energy by a centrifugal force and are directed toward the one fluid discharge region through the paired fluid channels and further toward the position to which the fluid is to be moved by this motor driven pump through the spiral shaped chamber and the conduit, not shown, of the pump housing. At the same time, fluid on the both side portions of the paired impellers in the inner space of the pump housing is sucked into the paired fluid inlet regions of the paired impellers.

In case of the above-described conventional motor-driven pump, a pair of fluid flows from the paired fluid inlet regions toward the one fluid discharge region through the paired fluid channels in the paired impellers collide against each other at a joint point of the paired fluid channels in the vicinity of the fluid discharge region. As a result, a joined fluid flow at the joint point applies the paired impellers with a force, which varies in a direction along the rotational center shaft and applies the rotational center shaft with a varying thrust force. Besides, if the discharge amount and discharge pressure of the fluid discharged from the motor-driven pump increase, the thrust force thereof is intensified accordingly.

For these reasons, in case of the conventional motor-driven pump described above, one of the bearings is a radial bearing and the other is a radial-thrust bearing. The thrust bearing disadvantageously complicates a constitution of the pump unit, increases an outside dimension thereof, and increases its weight and manufacturing cost thereof.

BRIEF SUMMARY OF THE INVENTION

The present invention has been derived from these circumstances. It is, therefore, an object of the present invention to provide a motor-driven pump having a plurality of impellers, capable of dispensing with a thrust bearing for a high thrust force, simple in constitution, small in outer dimension, small in weight and low in manufacturing cost.

To achieve the above object, a motor-driven pump with a plurality of impellers according to the present invention, comprises:

an electric motor including an output shaft, a motor frame rotatably supporting the output shaft while at least one end portion of the output shaft is protruded outward, and a rotation driving mechanism provided in the motor frame and rotating the output shaft in a predetermined direction when the mechanism is supplied with electric power;

a pump housing provided on a side of the one end portion of the output shaft in the electric motor, having two fluid inlet port regions on a side near the electric motor and on a side away from the electric motor in a longitudinal direction of the output shaft, respectively, and having one fluid discharge port region between the two fluid inlet port regions; and an impeller unit including a pair of impellers having a partition wall concentrically fixed to the one end portion of the output shaft in an inner space of the pump housing, directing to the one fluid discharge port region, spreading outward in a radial direction of the output shaft and partitioning the inner space into a portion near the electric motor and a portion away from the electric motor, and a pair of blade means provided on both sides of the partition wall, respectively, the impeller unit moving fluid on the both sides of the partition wall from inside to outside in the radial direction along the pair of blade means of the pair of impellers by a centrifugal force in the inner space when the impeller unit is rotated by the output shaft of the electric motor in the predetermined direction.

With this constitution, while the fluids on the both sides of the partition wall are moved from inside to outside in the radial direction of the output shaft by the pair of blade means on the both sides of the partition wall in the inner space of the pump housing and reach the one fluid discharge port region of the pump housing, the fluids on both sides are separated from each other by the partition wall. Accordingly, the fluids moved as stated above are not mixed with each other on the both sides of the partition wall, and thrust forces applied to the impeller unit by the fluids moved on the both sides of the partition wall as stated above, does not vary. Then, it is possible to set that the fluids moved on the both sides of the partition wall as stated above always mutually cancel the thrust forces applied to the impeller unit.

Due to this, the motor-driven pump with a plurality of impellers according to the present invention dispenses with a thrust bearing for a high thrust force, is simple in constitution, small in outer dimension, small in weight and low in manufacturing cost.

In the motor-driven pump with a plurality of impellers according to the invention constituted as described above, a radial bearing rotatably supporting the other end portion of the output shaft can be provided in an opposite portion to the pump housing in the motor frame of the electric motor; and another radial bearing rotatably supporting the one end portion of the output shaft can be provided in a portion adjacent the pump housing in the motor frame of the electric motor.

Alternatively, a radial bearing rotatably supporting the other end portion of the output shaft can be provided in an opposite portion to the pump housing in the motor frame of the electric motor; and another radial bearing rotatably supporting the one end portion of the output shaft can be provided in a portion, located outward from the one end portion in the longitudinal direction of the output shaft, in the pump housing of the electric motor.

In the motor-driven pump according to the invention constituted as described above, in the pump housing, the fluid inlet port region on the side away from the electric motor can open outward in the longitudinal direction of the one end portion of the output shaft; and in the pump housing, the fluid inlet port region on the side adjacent the electric motor can open outward in the radial direction of the output shaft.

In this case, it is preferable that the one fluid discharge port region of the pump housing has a plurality of fluid discharge ports; and that the plurality of fluid discharge ports are arranged equidistantly in a circumferential direction of the one end portion of the output shaft.

If so, it is possible to set that fluids discharged from the plurality of fluid discharge ports of the fluid discharge port region can mutually cancel radial forces applied to the impeller unit in the radial direction of the output shaft. Due to this, it is possible to make a constitution of the radial bearing small in size and to further reduce its outside dimension and price of the motor-driven pump according to the present invention.

The extending ends of the plurality of fluid discharge ports can be integrated into one end.

To achieve the above object, another motor-driven pump with a plurality of impellers according to the present invention, comprises:

an electric motor including an output shaft, a motor frame rotatably supporting the output shaft while at least one end portion of the output shaft is protruded outward, and a rotation driving mechanism provided in the motor frame and rotating the output shaft in a predetermined direction when the mechanism is supplied with electric power;

a pump housing provided on a side of the one end portion of the output shaft in the electric motor, having two fluid inlet port regions on a side near the electric motor and on a side away from the electric motor in a longitudinal direction of the output shaft, respectively, and having one fluid discharge port region between the two fluid inlet port regions; and an impeller unit including a pair of impellers having a partition wall concentrically fixed to the one end portion of the output shaft in an inner space of the pump housing, directing to the one fluid discharge port region, spreading outward in a radial direction of the output shaft and partitioning the inner space into a portion near the electric motor and a portion away from the electric motor, and a pair of blade means provided on both sides of the partition wall, respectively, the impeller unit moving fluid on the both sides of the partition wall from inside to outside in the radial direction along the pair of blade means of the pair of impellers by a centrifugal force in the inner space when the impeller unit is rotated by the output shaft of the electric motor in the predetermined direction, and wherein an inner space penetrated by the output shaft is provided in the motor frame of the electric motor;

the motor frame further includes a pump housing communication port region for communicating the inner space with the one fluid inlet port region located at the side near the electric motor in the pump housing, and an external communication port region for communicating the inner space with an outer space of the motor frame on the side farther from the pump housing than the pump housing communication port region in the longitudinal direction of the output shaft;

the outer space is filled with fluid; and the electric motor includes an axial-flow impeller unit, provided at the output shaft in the inner space, for moving the fluid in the inner space toward the pump housing communication port region along the longitudinal direction of the output shaft by the rotation of the output shaft in the predetermined direction.

With this constitution, while the fluids on the both sides of the partition wall are moved from inward to outward in the radial direction of the output shaft by the pair of blade means on the both sides of the partition wall in the inner space of the pump housing and reach the one fluid discharge port region of the pump housing, the fluids on both sides are separated from each other by the partition wall. Accordingly, the fluids moved as stated above are not mixed with each other on the both sides of the partition wall, and thrust forces applied to the impeller unit by the fluids moved on the both sides of the partition wall as stated above, does not vary. Then, it is possible to set that the fluids moved on the both sides of the partition wall as stated above always mutually cancel the thrust forces applied to the impeller unit.

Due to this, another motor-driven pump with a plurality of impellers described above and according to the present invention dispenses with a thrust bearing for a high thrust force, is simple in constitution, small in outer dimension, small in weight and low in production cost.

Moreover, according to this invention, fluid can be supplied to the electric motor side on the partition wall in the inner space of the pump housing by the axial-flow impeller unit of the electric motor. Therefore, this invention can reduce a capacity of the electric motor side on the partition wall in the inner space of the pump housing and reduce the dimension of the pump housing in the direction along the output shaft (i.e., the dimension of the motor-driven motor of this invention in the above direction) without deteriorating the performance of the motor-driven pump according to this invention such as discharge amount and discharge pressure of fluid discharged therefrom.

In another motor-driven pump described above and according to this invention, a radial bearing rotatably supporting the other end portion of the output shaft can be provided in an opposite portion to the pump housing in the motor frame of the electric motor; and another radial bearing rotatably supporting the one end portion of the output shaft can be provided in a portion adjacent the pump housing in the motor frame of the electric motor.

In addition, it is preferable that the rotation driving mechanism of the electric motor includes a rotor fixed to the output shaft in the inner space of the motor frame, and a stator opposite to the rotor in a radial direction of the output shaft in the motor frame; a concave portion elongated in the longitudinal direction of the rotor is formed on an outer peripheral surface of the rotor, a circumferential position of the concave portion deviated while extending in the longitudinal direction of the output shaft; and the rotor having the concave portion constitutes the axial-flow impeller unit.

The axial-flow impeller unit thus constituted is simple and compact in constitution and easy to manufacture.

In another motor-driven pump described above and according to this invention, it is preferable that in the pump housing, the fluid inlet port region on the side away from the electric motor opens outward in the longitudinal direction of the one end portion of the output shaft; and that in the pump housing, the fluid inlet port region on the side adjacent the electric motor opens toward the electric motor in the longitudinal direction of the output shaft.

The axial-flow impeller unit can efficiently feed fluid into the fluid inlet port region in such a pump housing from the pump housing communication port region of the motor frame of the electric motor.

In another motor-driven pump described above and according to this invention, it is preferable that the one fluid discharge port region of the pump housing has a plurality of fluid discharge ports; and the plurality of fluid discharge ports are arranged equidistantly in a circumferential direction of the one end portion of the output shaft.

If so, it is possible to set that fluids discharged from the plurality of fluid discharge ports of the fluid discharge port region can mutually cancel radial forces applied to the impeller unit in the radial direction of the output shaft. Due to this, it is possible to make the constitution of the radial bearing small in size and to further reduce the outside dimension and price of the motor-driven pump according to the present invention.

The extending ends of the plurality of fluid discharge ports can be integrated into one end.

In another motor-driven pump described above and according to this invention, it is preferable that a portion adjacent the pump housing around the output shaft and exposed to the pump housing communication port region in the motor frame is inclined inward in the radial direction of the output shaft as the portion is closer to the partition wall of the impeller unit.

If so, the axial-flow impeller unit can efficiently feed fluid into the fluid inlet port region in such a pump housing from the pump housing communication port region of the motor frame of the electric motor.

In another motor-driven pump described above and according to this invention stated above, a radial bearing rotatably supporting the other end portion of the output shaft can be provided in an opposite portion to the pump housing in the motor frame of the electric motor; and another radial bearing rotatably supporting the one end portion of the output shaft can be provided in a portion, located outward from the one end portion in the longitudinal direction of the output shaft, in the pump housing of the electric motor.

In this case, if the rotation driving mechanism of the electric motor includes a rotor fixed to the output shaft in the inner space of the motor frame, and a stator opposite to the rotor outward in the radial direction of the output shaft in the motor frame, a concave portion elongated in the longitudinal direction of the rotor is formed on an outer peripheral surface of the rotor, a circumferential position of the concave portion deviated while extending in the longitudinal direction of the output shaft and the rotator having the concave portion constitutes the axial-flow impeller unit, then it is preferable that a portion of the rotor adjacent the pump housing around the output shaft is exposed to the pump housing communication port region of the motor frame, and inclined inward in the radial direction of the output shaft as the portion is closer to the partition wall of the impeller unit.

Since the portion of the rotor adjacent the pump housing around the output shaft is inclined as stated above, the axial-flow impeller unit can efficiently feed fluid into the fluid inlet port region in such a pump housing fluid from the pump housing communication port region of the motor frame of the electric motor.

To achieve the above object, yet another motor-driven pump with a plurality of impellers according to the present invention, comprises:

an electric motor including an output shaft, a motor frame rotatably supporting the output shaft while at least one end portion of the output shaft is protruded outward, and a rotation driving mechanism provided in the motor frame and rotating the output shaft in a predetermined direction when the mechanism is supplied with electric power;

a pump housing provided on a side of the one end portion of the output shaft in the electric motor, having two fluid inlet port regions on a side near the electric motor and on a side away from the electric motor in a longitudinal direction of the output shaft, respectively, and having one fluid discharge port region between the two fluid inlet port regions; and an impeller unit including an impeller having a partition wall concentrically fixed to the one end portion of the output shaft in an inner space of the pump housing, directing to the one fluid discharge port region, spreading outward in a radial direction of the output shaft and partitioning the inner space into a portion near the electric motor and a portion away from the electric motor, and a blade means provided on a side away from the electric motor on the partition wall, the impeller unit moving fluid on the side away from the electric motor on the partition wall from inside to outside in the radial direction along the blade means of the impeller by a centrifugal force in the inner space when the impeller unit is rotated by the output shaft of the electric motor in the predetermined direction, and wherein an inner space penetrated by the output shaft is provided in the motor frame of the electric motor;

the motor frame further includes a pump housing communication port region for communicating the inner space of the motor frame with the one fluid inlet port region located at the side near the electric motor it the pump housing, and an external communication port region for communicating the inner space of the motor frame with an outer space of the motor frame on the side farther from the pump housing than the pump housing communication port region in the longitudinal direction of the output shaft;

the outer space is filled with fluid; and the electric motor includes an axial-flow impeller unit, provided at the output shaft in the inner space, for moving the fluid in the inner space toward the pump housing communication port region along the longitudinal direction of the output shaft by the rotation of the output shaft in the predetermined direction.

With this constitution, while the fluids on the both sides of the partition wall are moved from inward to outward in the radial direction of the output shaft by the blade means on one side of the partition wall and by the axial-flow impeller unit of the electric motor in the inner space of the motor frame and reach the one fluid discharge port region of the pump housing, the fluids on both sides are separated from each other by the partition wall. Accordingly, the fluids moved as stated above are not mixed with each other on the both sides of the partition wall, and thrust forces applied to the impeller unit by the fluids moved on the both sides of the partition wall as stated above, does not vary. Then, it is possible to set that the fluids moved on the both sides of the partition wall as stated above always mutually cancel the thrust forces applied to the impeller unit.

Due to this, yet another motor-driven pump with a plurality of impellers described above and according to the present invention dispenses with a thrust bearing for a high thrust force, is simple in constitution, small in outer dimension, small in weight and low in production cost.

Moreover, according to this invention, the fluid can be supplied to the electric motor side on the partition wall in the inner space of the pump housing by the axial-flow impeller unit of the electric motor. Therefore, this invention can reduce a capacity of the electric motor side on the partition wall in the inner space of the pump housing, and further, since the blade means is not provided on the electric motor side on the partition wall, this invention can reduce the dimension of the pump housing in the direction along the output shaft (i.e., the dimension of the motor-driven motor of this invention in the above direction), without deteriorating the performance of the motor-driven pump according to this invention such as discharge amount and discharge pressure of fluid discharged therefrom or even if the performance is to be improved.

In yet another motor-driven pump described above, a radial bearing rotatably supporting the other end portion of the output shaft can be provided in an opposite portion to the pump housing in the motor frame of the electric motor; and another radial bearing rotatably supporting the one end portion of the output shaft can be provided in a portion, located outward from the one end portion of the output shaft in the longitudinal direction in the pump housing.

In this case, it is preferable that the rotation driving mechanism of the electric motor includes a rotor fixed to the output shaft in the inner space of the motor frame, and a stator opposite to the rotor in a radial direction of the output shaft in the motor frame; a concave portion elongated in the longitudinal. direction of the rotor is formed on an outer peripheral surface of the rotor, a circumferential position of the concave portion deviated while extending to the longitudinal direction of the output shaft; and the rotor having the concave portion constitutes the axial-flow impeller unit.

The axial-flow impeller unit thus constituted is simple and compact in constitution and easy to manufacture.

If a portion of the rotor adjacent the pump housing around the output shaft is exposed to the pump housing communication port region of the motor frame and is abutted against a side of the electric motor of the partition wall of the axial-flow impeller unit, it is possible to more efficiently flow the fluid from the axial-flow impeller unit into the pump housing through the pump housing communication port region of the motor frame.

In yet another motor-driven pump stated above, it is preferable that in the pump housing, the fluid inlet port region on the side away from the electric motor opens outward in the longitudinal direction of the one end portion of the output shaft; and that in the pump housing, the fluid inlet port region on the side adjacent the electric motor opens toward the electric motor in the longitudinal direction of the output shaft.

If so, the axial-flow impeller unit can efficiently feed fluid into the fluid inlet port region of the pump housing from the pump housing communication port region of the motor frame of the electric motor.

If the one fluid discharge port region of the pump housing has a plurality of fluid discharge ports, and the plurality of fluid discharge ports are arranged equidistantly in a circumferential direction of the one end portion of the output shaft, this can reduce the radial forces applied to the output shaft and reduce the outer dimension and manufacturing cost of yet another motor-driven pump according to this invention as stated above in the case of the motor-driven pump according to this invention and another motor-driven pump according to this invention.

Needless to say, the extending ends of the plurality of fluid discharge ports can be integrated into one end.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Various embodiments and modifications of a motor-driven pump according to the present invention will be described hereinafter in detail with reference to the accompanying drawings.

(First Embodiment)

Figure 1:
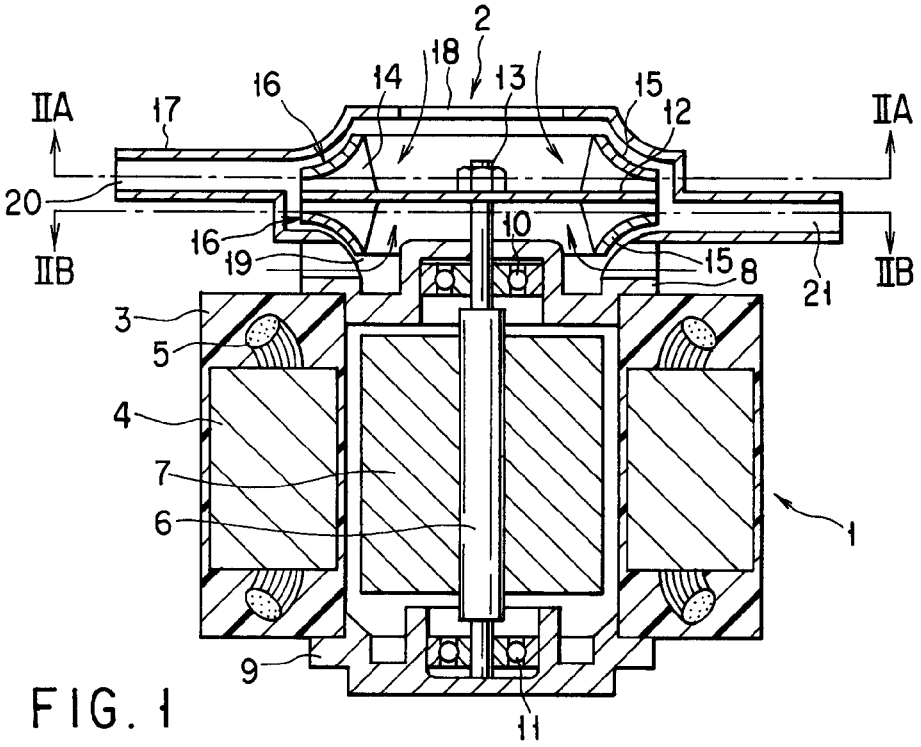
FIG. 1 is a schematic longitudinal sectional view of a motor-driven pump according to a first embodiment of the present invention.

FIG. 1 is a longitudinal sectional view showing a constitution of a motor-driven pump according to a first embodiment of the present invention. This motor-driven pump includes an electric motor 1 and a pump unit 2. The electric motor 1 has a rotor 7 and a cylindrical stator 3 in an inner space of which the rotor 7 is arranged.

The stator 3 has a stator core 4 having six magnetic poles arranged at intervals of 60° in a circumferential direction of the core 4. An exciting winding 5 is wound around the stator core 4. An insulating resion such as polyester are molded on the stator core 4 and the exciting winding 5 to surround cylindrically them and to make the stator 3 waterproof. Both end openings of the stator 3 are watertightly covered with motor frames 8, 9. The rotor 7 has four poles coaxially fixed to an output shaft 6, and the shaft 6 is rotatably supported by a pair of radial bearings 10, 11 on the motor frames 8, 9. The stator 3 and rotor 7 constitute a three-phase motor.

In the electric motor 1, three phases are wired by Y-connection and three leads are pulled outside. Three-phase alternating currents in which three phases are shifted by electrical angle of 120° to each other are supplied to the leads and a rotational speed of the output shaft 6 can be varied by changing the frequencies of the currents.

One end portion of the output shaft 6 protrudes outward from the frame 8 and a female screw is formed on the tip end of the one end portion.

The pump unit 2 is arranged on the motor frame 8. The pump unit 2 includes a disk-shaped partition wall 12 coaxially fitted on the tip end of the one end portion of the output shaft 6, and the partition wall 12 is fixed on the tip end by screwing a nut 113 on the bolt on the tip end.

Six blades 14 are arranged on each of both side surfaces of the partitions wall 12 at equiangular intervals, and forms oblique plates 15, thereby forming two centrifugal impellers 16 on the both side surfaces of the partition wall 12.

The pump unit 2 further includes a pump housing 17 which surrounds the centrifugal impellers 16 and one end of which is fixed to the frame 8 of the electric motor 1. The pump housing 17 has two fluid inlet port regions 18 and 19 formed on both sides of the partition wall 12 and one fluid outlet port region formed between the two inlet port regions 18 19. In this embodiment, the fluid outlet port region has two fluid discharge ports 20 and 21 arranged at equiangular intervals, i.e., at intervals of 180°, in a circumferential direction of the housing 17. One fluid inlet port region 18 located at a position away from the motor 1 opens outward in a longitudinal direction of the one end portion of the shaft 6, and the other fluid inlet port region 19 located at a position near the motor frame 8 of the motor 1 opens toward the motor frame 8. The other inlet port 19 is communicated with an outer space through an opening region in the frame 8, and the opening region has a plurality of ports orientated outward in a radial direction of the shaft 6 and arranged equidistantly in a circumferential direction of the shaft 6.

Figure 2A:
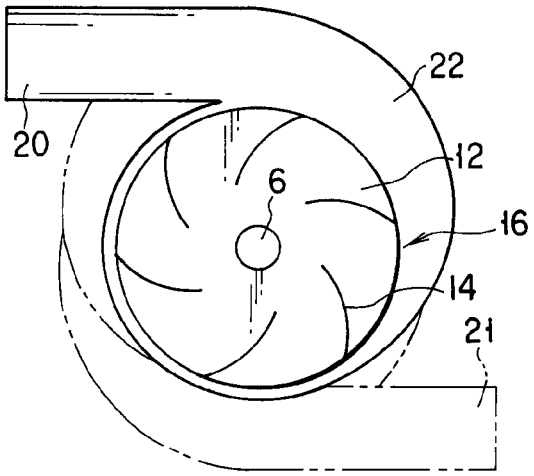
FIG. 2A is a schematic cross-sectional view taken along a line IIA—IIA of FIG. 1.
Figure 2B:
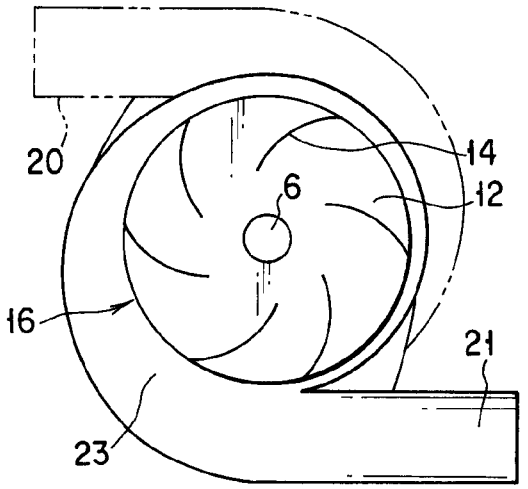
FIG. 2B is a schematic cross-sectional view taken along a line IIB—IIB of FIG. 1.

FIG. 2A is a cross-sectional view taken along a line IIA—IIA of FIG. 1, and FIG. 2B is a cross-sectional view taken along a line IIB—IIB of FIG. 1. As shown in FIGS. 2A and 2B, the pump housing 2 has two spiral shaped chambers 22 and 23 at positions corresponding to radially outward ends of the impellers 16 on the partition wall 12. Outer ends of the spiral shaped chamber 22 and 23 are communicated with the discharge parts 20, 21.

In an operation state, the motor-driven pump constituted as described above is sunk in a fluid, for example, a water and the three phase alternating currents are supplied to the electric motor 1 so that the output shaft 6 rotates in a predetermined direction.

When the output shaft 6 rotates as described above, an impeller unit having two impellers 16 rotates in the predetermined direction. While the impellers 16 rotates as described above, the fluids in the impellers 16 are given Kinetic energy by the Centrifugal force to move radially outward and are discharged into the spiral shaped chambers 22, 23. The discharged fluids are decelerated and its pressure is increased in the spiral shaped chambers 22, 23, and they are finally discharged out from the discharge ports 20, 21. At the same time, fluid located around the pump is sucked through the two fluid inlet port regions 18, 19 as indicated by arrows and reaches at the radial center portions of the impellers 16 on the both sides of the partition walls 12.

As can be seen, in the pump unit 2, the inlet ports 18 and 19 are provided on the both sides of the pump housing 17 in the longitudinal direction of the output shaft 6 and fluid is sucked into the radial center portions of the impellers 16 along the longitudinal direction of the output shaft 6. Thus, thrust loads applied to the output shaft 6 through the impeller unit during the rotation of the impellers 16 cancel each other. It is, therefore, possible to decrease the thrust load on the output shaft 6, to dispose with a thrust bearing for a high thrust load and to make the bearings 10, 11 simple in constitution and small in size.

Further, in the pump unit 2, since the two fluid discharge ports 20 and 21 are arranged in the circumferential direction at intervals of 180°, radial loads applied to the output shaft 6 through the impeller unit during the rotation of the impellers 16 cancel each other. Thus, it is possible to decrease the radial loads on the output shaft 6, as well.

Accordingly, it is possible to decrease both the thrust loads and the radial loads applied to the rotary shaft 6 and to make the bearings 10, 11 simpler in constitution and smaller in size.

Therefore, even if the motor-driven pump of this embodiment is used as a high lift pump, the thrust load is stable and light, and eccentric abrasion of the bearing generated by the unstable radial load is decreased, so that abrasion of sliding portions in the pump is greatly decreased. Besides, vibration and noise generated in the pump are reduced.

Accordingly, it is possible to realize a motor-driven pump which operates more efficiently, is small in size, and has a high reliability.

In this embodiment, the pump housing 17 has two spiral shaped chambers 22 and 23 corresponding to the two impellers 16 on the both sides of the partition wall 112, and has the two discharge ports 20 and 21 communicated with the spiral shaped chambers 22 and 23 and arranged at intervals of 180° in the circumferential direction of the housing 17. However, the constitution of the pump unit 2 should not be limited to that described above.

Figure 3:
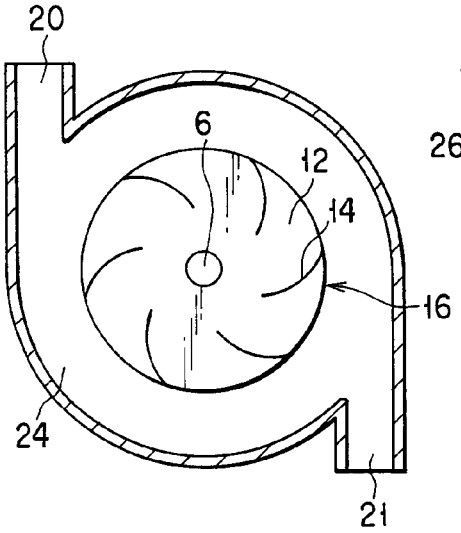
FIG. 3 is a schematic cross-sectional view showing a first modification of a pump housing shown in FIG. 1.
Figure 4:
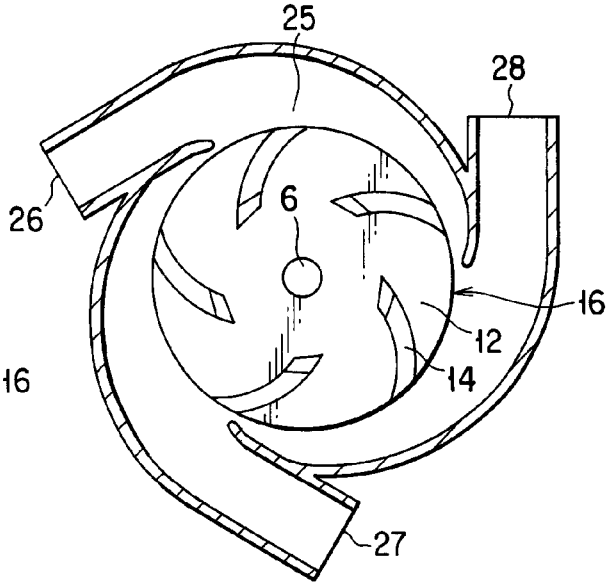
FIG. 4 is a schematic cross-sectional view showing a second modification of the pump housing shown in FIG. 1.

As shown in, for example, FIG. 3, a pump unit having a common spiral shaped chamber 24 formed in a pump housing to:correspond to two impellers 16 on both side surfaces of a partition wall 12, and having two discharge ports 20 and 21 communicated with the common chamber 24 may be used. Alternatively, as shown in FIG. 4, a pump unit having a common spiral shaped chamber 25 formed in a pump housing to correspond to two impellers 16 on both side surfaces of a partition wall 12, and having three discharge ports 26, 27 and 28 communicated with the scroll chamber 25 and arranged at intervals of 120° may be used.

Further, the constitution of each of the impellers 16 should not be limited to that of this embodiment and the shapes of the blades 14 may be variably modified.

(Second Embodiment)

In the second embodiment, the same constituent members as those in the first embodiment are denoted by the same reference numerals and only different members from those in the first embodiment will be described hereinafter.

Figure 5:
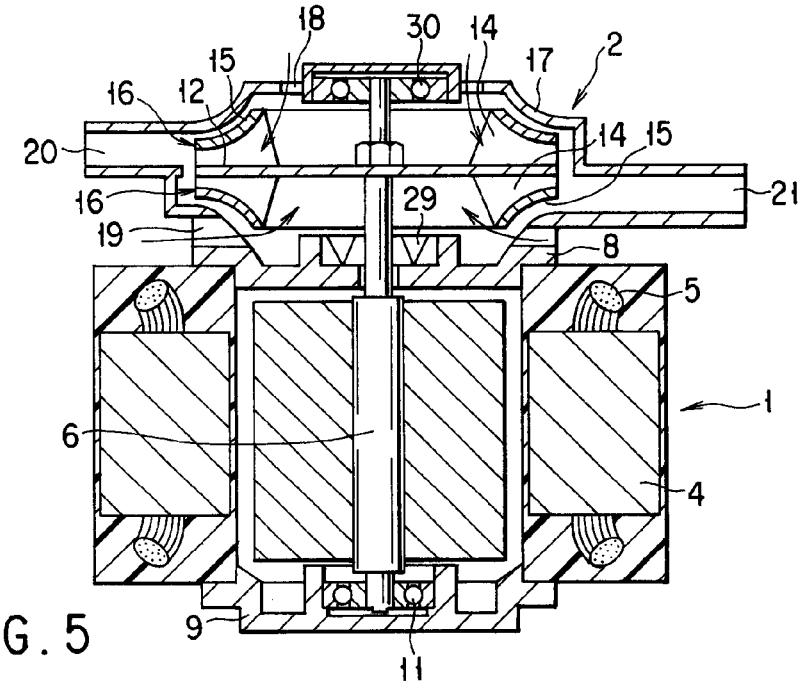
FIG. 5 is a schematic longitudinal sectional view of a motor driven pump according to a second embodiment of the present invention.

In this embodiment, as shown in FIG. 5, a water tight seal 29 is provided, instead of the bearing 10, on the motor frame 8 of the electric motor 1, and a radial bearing 30 is provided on a part of the pump housing 17 located away from the motor 1 than the impeller unit. The output shaft 6 is rotatably and watertightly projected outward from the motor frame 8 and the tip end of the shaft 6 is rotatably supported by this bearing 30.

With this constitution, the impeller unit is located near the motor 1 than the bearing 30. The motor-driven pump of this second embodiment can exhibit the same advantages as those in the first embodiment. Sine no water is introduced into the inner space of the motor, there is no need to apply a water protection to the windings, so that no friction loss generated by water between the rotor and the stator and the efficiency of the motor is improved.

(Third Embodiment)

In the third embodiment, the same constituent members as those in the first embodiment are denoted by the same reference numerals and only different members from those in the first embodiment will be described hereinafter.

Figure 6:
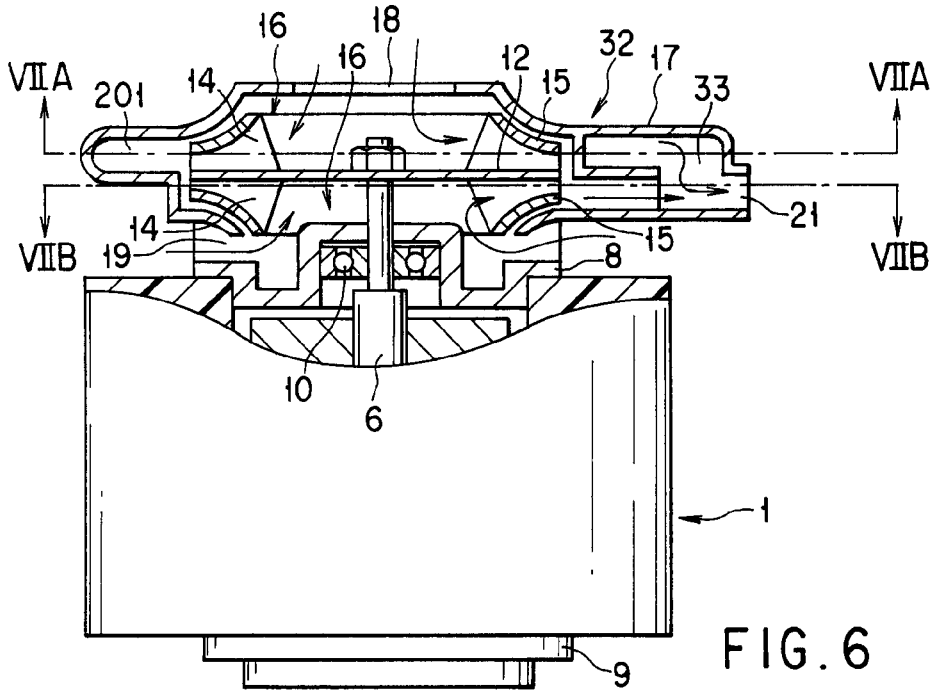
FIG. 6 is a side view of a motor-driven pump according to a third embodiment of the present invention with a main part of the pump are shown in longitudinal section.
Figure 7A:
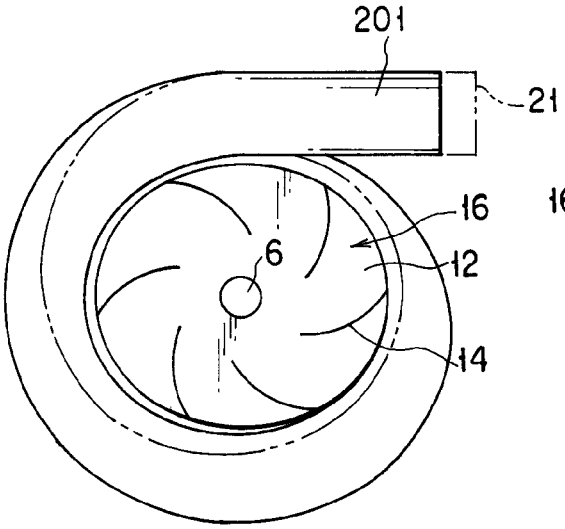
FIG. 7A is a schematic cross-sectional view taken along a line VIIA—VIIA of FIG. 6.
Figure 7B:
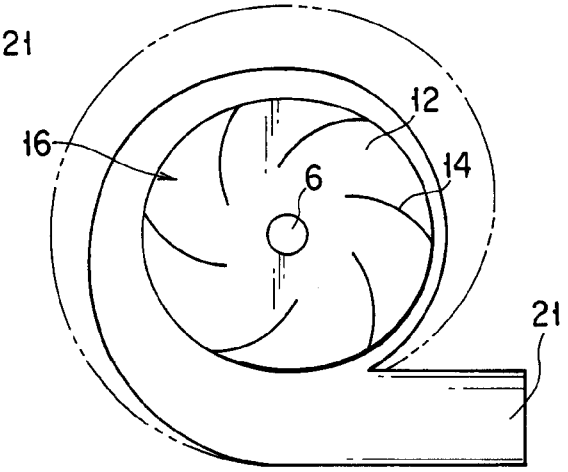
FIG. 7B is a schematic cross-sectional view taken along a line VIIB—VIIB of FIG. 6.
Figure 8A:
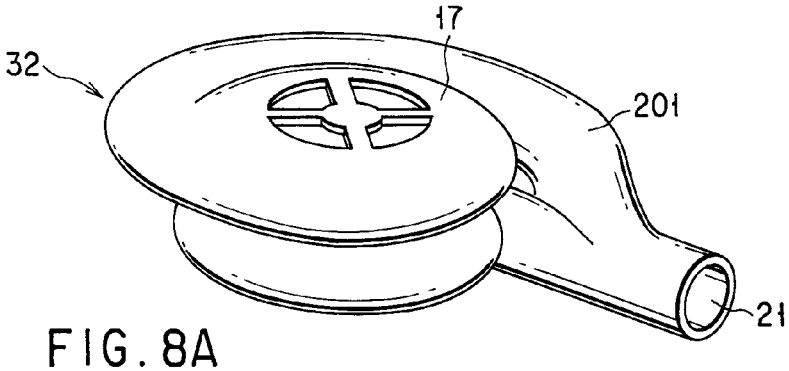
FIG. 8A is a perspective view of a pump housing shown in FIG. 6.
Figure 8B:
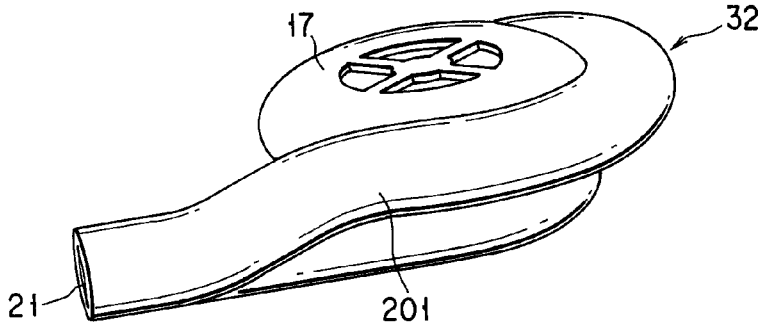
FIG. 8B is a perspective view of the pump housing shown in FIG. 6 while the pump housing is viewed from a direction different from that in FIG. 8A.

As show in FIG. 6, a constitution of a pump housing 17 of a pump unit 32 is different from that of the pump unit 2 in the first embodiment described above. FIG. 7A is a cross-sectional view of the pump housing 17 of this pump unit 32 taken along line VIIA—VIIA of FIG. 6, and FIG. 7B is a cross-sectional view of the pump housing 17 of this pump unit 32 taken along line VIIB—VIIB of FIG. 6. Also, FIG. 8A is a perspective view of the pump housing 17 of the pump unit 32, and FIG. 8B is a perspective view thereof but it is viewed from an opposite side to that of FIG. 8B. As shown in FIGS. 7A, 7B, 8A and 8B, one of the two spiral shaped chambers is extended to surround an outer circumferential surface of the pump housing 17, and one discharge port 201 of the one spiral shaped chamber is joined to the other discharge port 21 at a connection point 33.

With this constitution, fluid sucked from two inlet port regions 18, 19 by the rotation of the impellers is discharged from the two impellers 16 to the two spiral shaped chambers at two radially oppositely positions, flowed in the two discharged ports 21, 201, and finally joined together at the connection point 33.

Even if one spiral shaped chamber extends to surround the outer circumferential surface of the pump housing 17, and finally the one discharge port 201 at the distal end of the one spiral shaped chamber is joined to the other discharge port 21, it is possible to realize the same performance and the same high efficiency as those of the above-described embodiments. The pump of this embodiment is small in size, produces high power and has high reliability.

(Fourth Embodiment)

In the fourth embodiment, the same constituent members as those in the preceding embodiments are denoted by the same reference numerals and only different members from those in the preceding embodiments will be described hereinafter.

In this embodiment, a centrifugal impeller unit having two impellers 16 housed in a pump housing 17 of a pump unit 2 is used in combination with an axial-flow impeller unit 44 housed in an inner space of a startor 3 of an electric motor 40.

Figure 10:
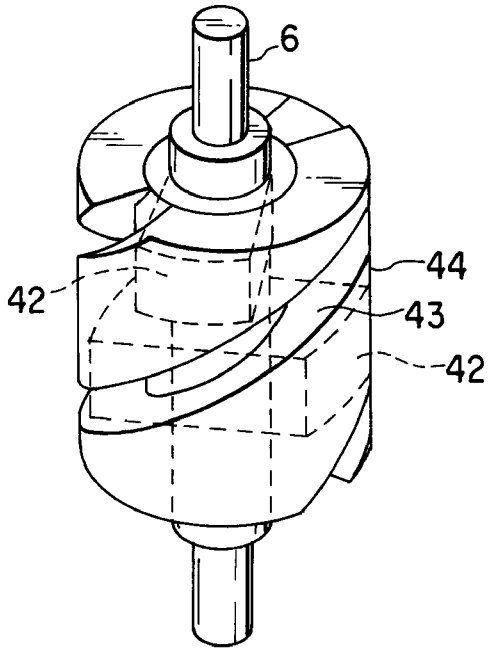
FIG. 10 is a schematic perspective view of a rotor of a motor of the motor-driven pump shown in FIG. 9.

In this embodiment, as shown in FIG. 10, a rotor 41 of the electric motor 40 arranged in the stator 3 has four poles 42 radially outwardly projecting from the output shaft 6. These poles 42 are shifted at an interval of 90° in the circumferential direction of the shaft 6 and alternatively magnetized in different magnetic poles. A plastic is molded on these poles 42 to have a cylindrical shape. An elongated concave 43 is provided on an outer peripheral surface of the cylindrical plastic to deflect in a circumferential direction of the cylindrical plastic while the concave extends in the longitudinal direction of the output shaft 6, thereby forming the axial-flow impeller unit 44 with the spiral shaped concave 43.

The electric motor 40 has a motor frame 45 fixed to the one-end side of the startor 3 near the pump unit 2 and a motor frame 46 fixed to the other end-side away from the pump unit 2. Radial bearings 10 and 11 rotatably supporting the output shaft 6 are provided on the frames 45 and 46, respectively.

Openings communicated with the inner space of the stator 3 are formed in the motor frames 45 and 46. The opening of the frame 45 is orientated in the longitudinal direction of the shaft 6 toward the fluid inlet port region 19 of the pump housing 17 near the motor 40 and is used as a pump housing communication port 47. The opening of the frame 46 orientated toward the outer space in the longitudinal direction of the shaft 6 and is used as an external communication port region 48.

With the above-stated constitution, the spiral shaped concave 43 formed in the outer peripheral surface of the rotor 41 works together with an inner peripheral surface of the stator 3 to transfer fluid introduced into the inner space of the stator 3 through the external communication port region 48 toward the pump housing communication port region 47 in the longitudinal direction. Also, by changing a width, depth, tilt angle, spiral pitch and the like of the spiral shaped concave 43, a performance of the axial flow impeller unit 44 can be changed.

Figure 9:
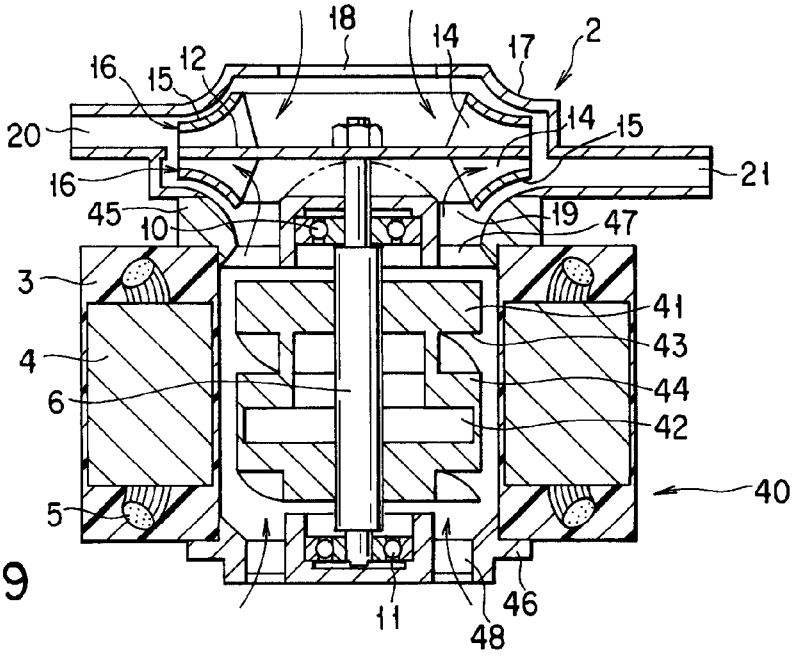
FIG. 9 is a schematic longitudinal sectional view of a motor-driven pump according to a fourth embodiment of the present invention.

When the electric motor 40 is driven, the output shaft 6 rotates the centrifugal impeller unit in the pump housing 17 and the axial-flow impeller unit 44 in the stator 3 in the predetermined direction. By this rotation, fluid located around the pump is sucked through the fluid inlet port region 18 into the portion located away from the motor 40 in the pump housing 17, and at the same time is subked through the external communication port 48 into the inner space of the stator 3 indicated by arrows shown in FIG. 9.

The fluid sucked into the inner space of the stator 3 is then transferred to the portion near the electric motor 40 in the pump housing 17 by the axial-flow impeller unit 44 through the pump housing communication port 47 of the motor 40 and the fluid inlet port region 19 of the pump housing 17 located near the motor 40. In this case, as indicated by a two-dot chain line in FIG. 9, if the outer peripheral surface of the motor frame 8 exposed in the fluid inlet port region 19 of the pump housing 17 on the electric motor side is inclined along the output shaft 16 so as to be directed radially inward of the output shaft 16 as it is close to the partition wall 12 of the centrifugal impeller unit, fluid can be flown more efficiently from the pump housing communication port 47 of the stator 3 into the motor side fluid inlet port region 19 of the pump housing 17. Finally, the fluid sucked into the pump housing 17 through the both fluid inlet port regions 18, 19 is accelerated by the impellers 16 on the both sides of the partition wall 12 toward the spiral shaped chamber in the pump housing 17 and then discharged from the fluid output ports 20 and 21.

As can be seen from the above, the axial-flow impeller unit 44 mainly constituted by the rotor 41 of the electric motor 40, cooperates with the centrifugal impellers 16 so that the performance of the pump can be improved further.

In this embodiment, since the fluid is sucked from the fluid inlet port region 18 provided on the portion away from the motor 40 in the pump housing 17 and at the same time is sucked from the fluid inlet port region 19 provided on the portion near the electric motor 40 in the pump housing 17, flowing directions of the fluids sucked from the two fluid inlet port regions are opposite to each other and thrust loads applied to the output shaft 6 through the impeller unit cancel each other. Thus, the thrust load on the output shaft 6 is reduced and the radial bearing 10, 11 can be made simple in constitution and small in size.

Moreover, in the pump unit 2, the two fluid discharge ports 20 and 21 are arranged in the outer circumferential direction of the output shaft 6 at intervals of 180°. Due to this, radial loads applied to the output shaft 6 during the rotation of the impeller unit cancel each other, whereby the radial loads applied on the output shaft 6 are reduced.

Accordingly, in this embodiment as in the case of the preceding embodiments, both the thrust loads and the radial loads applied to the output shaft 6 is reduced and the radial bearing 10, 11 can be made simpler in constitution and smaller in size.

Therefore, even if the motor-driven pump of this embodiment is used as a high lift pump, the thrust load is stable and light and eccentric abrasion generated by the unstable radial load is decreased, so that abrasion of sliding portions in the pump is greatly decreased. Besides, vibration and noise generated in the pump are reduced.

Accordingly, it is possible to realize a motor-driven pump which operates more efficiently, is small in size, and has a high reliability.

(Fifth Embodiment)

In the fifth embodiment, the same constituent members as those in the preceding embodiments are denoted by the same reference numerals and only different members from those in the preceding embodiments will be described hereinafter.

Figure 11:
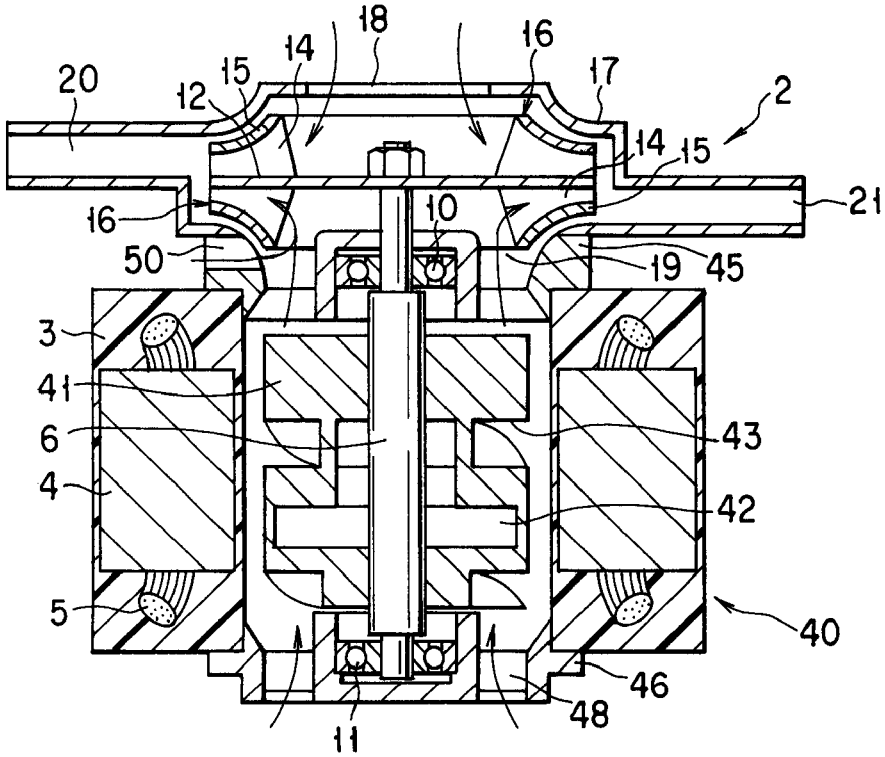
FIG. 11 is a schematic longitudinal sectional view of a motor-driven pump according to a fifth embodiment of the present invention.

As shown in FIG. 11, in this embodiment, an additional fluid inlet port region 50 is provided in the motor frame 45 located near to the pump housing 17. The additional fluid inlet port region 50 opens in the radial direction of the output shaft 6, and fluid is also sucked from this addition fluid inlet port region 50 into the fluid inlet port region 19 near the motor 40 in the pump housing 17.

With this constitution, it is possible to increase the amount of fluid sucked into the inner space of the pump housing 17 per a unit of time and then the performance of the pump of this embodiment can be further improved.

In this embodiment as in the case of the preceding embodiments, it is possible to realize a motor-driven pump which operates more efficiently, is small in size, and has a high reliability.

(Sixth Embodiment)

In this sixth embodiment, the same constituent members as those in the preceding embodiments are denoted by the same reference numerals and only different members from those in the preceding embodiments will be described hereinafter.

Figure 12:
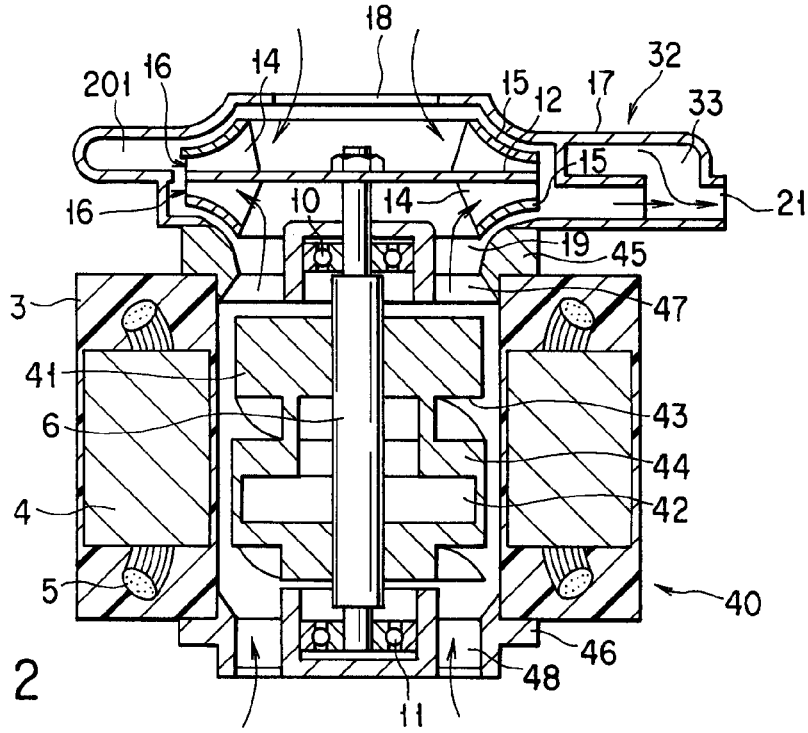
FIG. 12 is a schematic longitudinal sectional view of a motor-driven pump according to a sixth embodiment of the present invention.

As shown in FIG. 12, a constitution of a pump housing 17 of a pump unit 32 is different from that of the pump unit 2 in the above-described fifth embodiment described above. The pump housing 17 of this pump unit 32 has the same shape as that of the pump unit 32 in the above-described third embodiment shown in FIG. 6. One of the two spiral shaped chambers is extended to surrounding an outer circumferential surface of the pump housing 17, and one discharge port 201 of the one spiral shaped chamber is joined to the other discharge port 21 at a connection point 33.

With this constitution, fluid sucked from the fluid inlet port region 18 by the centrifugal impeller 16 located away from the motor 40 and fluid sucked from the fluid inlet port region 19 by the centrifugal impeller 16 located near the motor 40 through the external connection port 48 and the pump housing connection hole 47 by the axial-flow impeller unit 44, are discharged from the two impellers 16 to the two spiral shaped chambers at two radially oppositely positions, flowed in the two discharge ports 21, 201, and finally joined together at the connection point 33.

Even if one spiral shaped chamber extends to surround the outer circumferential surface of the pump housing 17, and finally the one discharge port 201 at the distal end of the one spiral shaped chamber is joined to the other discharge port 21, it is possible to realize the same performance and the same high efficiency as those of the above-described embodiment. The pump of this embodiment is small in size, produces higher power and has high reliability.

(Seventh Embodiment)

In the seventh embodiment, the same constituent members as those in the proceeding embodiments are denoted by the same reference numerals and only different members from those in the preceding embodiments will be described hereinafter.

Figure 13:
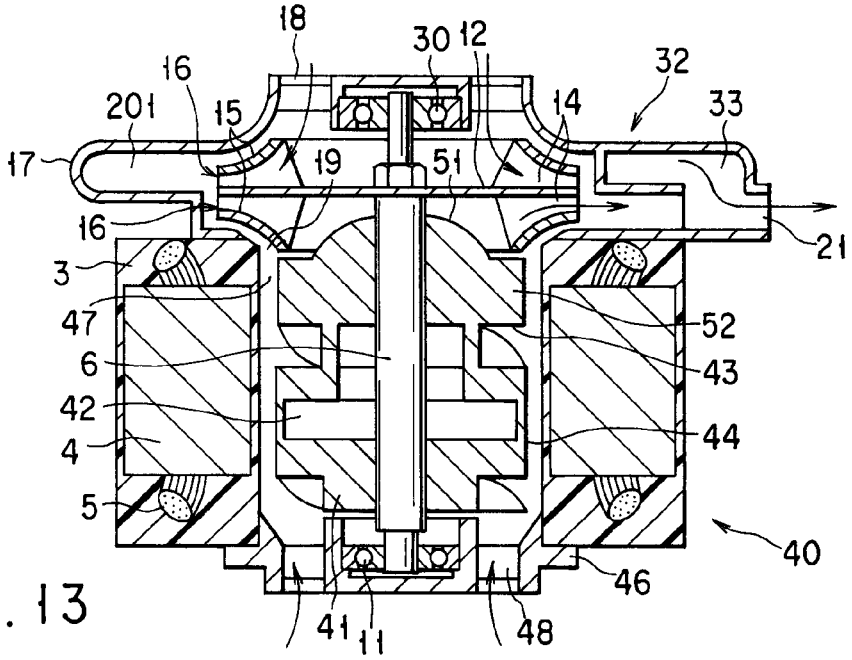
FIG. 13 is a schematic longitudinal sectional view of a motor-driven pump according to a seventh embodiment of the present invention.

As shown in FIG. 13, a radial bearing 30 is provided on a portion of the pump housing 17 located away from the motor 40 than the impeller unit, and the tip end of the shaft 6 is rotatably supported by this bearing 30.

Further, the pump housing 17 is directly fixed to the one-end side of the stator 3 of the electric motor 40. One end potion 51 of a rotor 52 projected in the fluid inlet port region 19 of the pump housing 17 is formed to have a semicircular circumferential surface. The semicircular circumferential surface is surrounded by the fluid inlet port region 19 and is inclined radially inward as it approaches to the partition wall 12 in the longitudinal direction of the output shaft 6.

With this constitution, since the end portion 51 of the rotor 52 is semicircular, fluid is smoothly transferred from the axial-flow impeller unit 44 to the centrifugal impeller 16 on the motor side of the partition wall 12 without generating vortex flow. Accordingly, it is possible to efficiently transfer fluid from the axial-flow impeller unit 44 to the centrifugal impeller 16 on the motor side of the partition wall 12, reduce noise and to prevent the occurrence of cavitation.

In this embodiment as in the case of the preceding embodiments, it is possible to realize a motor-driven pump which has a further improved efficiency, is small in size, produces a higher power and has a high reliability.

(Eight Embodiment)

In the eighth embodiment, the same constituent members as those in the preceding embodiments are denoted by the same reference numerals and only different members from those in the preceding embodiments will be described hereinafter.

Figure 14:
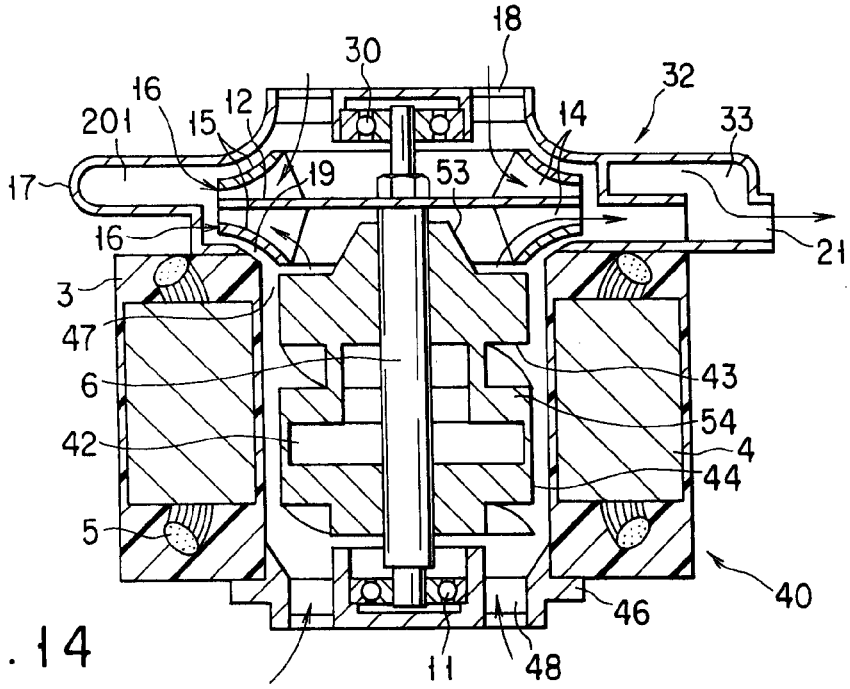
FIG. 14 is a schematic longitudinal sectional view of a motor-driven pump according to an eighth embodiment of the present invention.

As shown in FIG. 14, a radial bearing 30 is provided on a portion of the pump housing 17 located away from the motor 40 than the impeller unit, and the tip end of the shaft 6 is rotatably supported by this bearing 30.

Further, the pump housing 17 is directly fixed to the one-end side of the stator 3 of the electric motor 40. One end potion 53 of a rotor 54 projected in the fluid inlet port region 19 of the pump housing is tapered such that it is inclined inward as it approaches to the partition wall 12 in the longitudinal direction of the output shaft 6.

With this constitution, since the end portion 53 of the rotor 54 is tapered, fluid is smoothly transferred from the axial-flow impeller unit 44 to the centrifugal impeller 16 on the motor side of the partition wall 12 without generating vortex flow. Accordingly, it is possible to efficiently transfer fluid from the axial-flow impeller unit 44 to the centrifugal impeller 16 on the motor side of the partition wall 12, reduce noise and to prevent the occurrence of cavitation.

In this embodiment as in the case of the preceding embodiments, it is possible to realize a motor-driven pump which has a further improved efficiency, is small in size, produces a higher power and has a high reliability.

(Ninth Embodiment)

In the ninth embodiment, the same constituent members as those in the preceding embodiments are denoted by the same reference numerals and only different members from those in the preceding embodiments will be described hereinafter.

Figure 15:
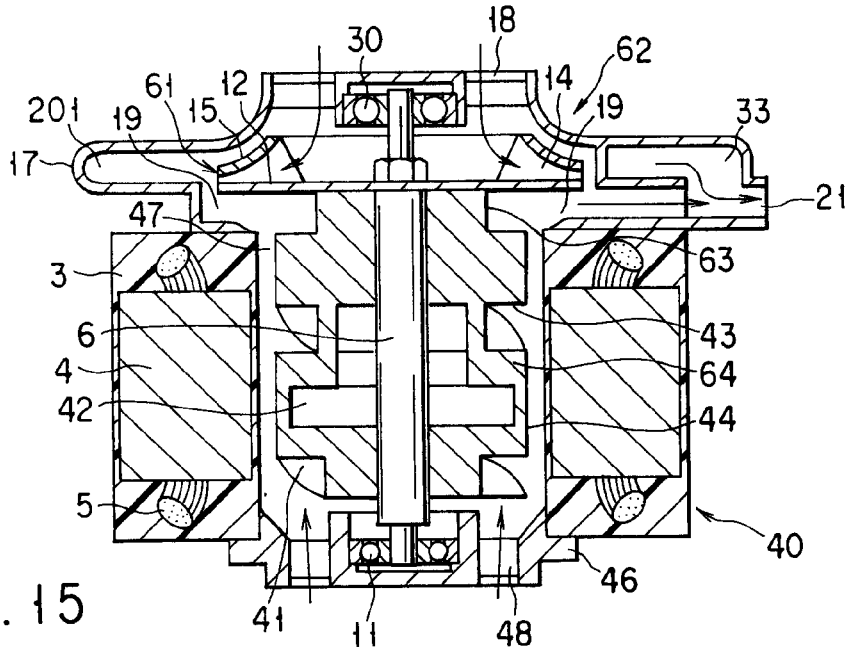
FIG. 15 is a schematic longitudinal sectional view of a motor-driven pump according to a ninth embodiment of the present invention.

As shown in FIG. 15, a radial bearing 30 is provided on a portion of the pump housing 17 located away from the motor 40 than the impeller unit, and the tip end of the shaft 6 is rotatably supported by this bearing 30. The pump housing 17 is directly fixed to the one-end side of the stator 3 of the electric motor 40.

In addition, an impeller unit of a pump unit 62 of this embodiment has a plurality of blades 14 only on one side of a partition wall 12 located away from the motor 40 so that a centrifugal impeller 61 is provided only on the one side of the partition wall 12.

Further, an end potion 63 of a rotor 64 projected into the fluid inlet port region 19 of the pump housing 17 located near the motor 40 is abutted against a side surface of the partition wall 12 located near the electric motor 40. Further, an outer circumferential surface of the end portion 63 of the rotor 64 is tapered such that it is away from the shaft 6 while it approaches the partition wall 12.

With this constitution, fluid sucked from the fluid inlet port region 18 provided on the position away from the motor 40 in the pump housing 17 by the rotation of the centrifugal impeller 61 is transferred into the spiral shaped chamber and reaches at the fluid outlet port 21 through the fluid outlet port 201 joined to the fluid outlet port 21 at the connection point 33. At the same time, fluid sucked from the external communication port 48 of the motor 40 located away from the pump unit 62 is transferred by the rotation of an axial-flow impeller unit 44 to the fluid inlet port region 19 provided on the position near the motor 40 in the pump housing 17 through the pump housing communication port 47 of the motor 40. The fluid transferred into the fluid inlet port region 19 is further flown into another spiral shaped chamber and reaches at the fluid outlet port 21.

Since the end portion 63 of the rotor 64 is tapered, fluid is smoothly transferred from the axial-flow impeller unit 44 to the fluid outlet port region 21 without generating vortex flow. Thus, it is possible to reduce noise and to prevent the occurrence of cavitaion.

In this embodiment as in the case of the preceding embodiments, it is possible to realize a motor-driven pump which has a further improved efficiency, is small in size, produces a higher power and has a high reliability.

The present invention should not be limited to the embodiments stated above and various changes and modifications can be made within the scope of the invention.

For example, in the various embodiments stated above, the centrifugal impeller 16 is formed on each of the both sides or one side of the partition wall 12. It is also possible, however, that the partition wall 12 is vertically dividable on a division surface orthogonal to the output shaft 6 and that the centrifugal impeller 16 is formed on each of the two vertically dividable partition wall halves.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A motor-driven pump with a plurality of impellers, comprising:

an electric motor including an output shaft, a motor frame rotatably supporting the output shaft while at least one end portion of the output shaft is protruded outward, and a rotation driving mechanism provided in the motor frame and rotating the output shaft in a predetermined direction when the mechanism is supplied with electric power;

a pump housing provided on a side of the one end portion of the output shaft in the electric motor, having two fluid inlet port regions on a side near the electric motor and on a side away from the electric motor in a longitudinal direction of the output shaft, respectively, and having one fluid discharge port region between the two fluid inlet port regions; and an impeller unit including a pair of impellers having a partition wall concentrically fixed to the one end portion of the output shaft in an inner space of the pump housing, directing to the one fluid discharge port region, spreading outward in a radial direction of the output shaft and partitioning the inner space into a portion near the electric motor and a portion away from the electric motor, and a pair of blade means provided on both sides of the partition wall, respectively, the impeller unit moving fluid on the both sides of the partition wall from inside to outside in the radial direction along the pair of blade means of the pair of impellers by a centrifugal force in the inner space when the impeller unit is rotated by the output shaft of the electric motor in the predetermined direction, wherein a radial bearing rotatably supporting the other end portion of the output shaft is provided in an opposite portion to the pump housing in the motor frame of the electric motor; and another radial bearing rotatably supporting the one end portion of the output shaft is provided in a portion, located outward from the one end portion in the longitudinal direction of the output shaft, in the pump housing of the electric motor.

2. A motor-driven pump according to claim 1, a radial bearing rotatably supporting the other end portion of the output shaft is provided in an opposite portion to the pump housing in the motor frame of the electric motor; and another radial bearing rotatably supporting the one end portion of the output shaft is provided in a portion adjacent the pump housing in the motor frame of the electric motor.

3. A motor-driven pump according to claim 1, wherein in the pump housing, the fluid inlet port region on the side away from the electric motor opens outward in the longitudinal direction of the one end portion of the output shaft; and in the pump housing, the fluid inlet port region on the side adjacent the electric motor opens outward in the radial direction of the output shaft.

4. A motor-driven pump according to claim 1, wherein the one fluid discharge port region of the pump housing has a plurality of fluid discharge ports; and the plurality of fluid discharge ports are arranged equidistantly in a circumferential direction of the one end portion of the output shaft.

5. A motor-driven pump according to claim 4, wherein extending ends of the plurality of fluid discharge ports are integrated into one end.

6. A motor-driven pump with a plurality of impellers, comprising:

an electric motor including an output shaft, a motor frame rotatably supporting the output shaft while at least one end portion of the output shaft is protruded outward, and a rotation driving mechanism provided in the motor frame and rotating the output shaft in a predetermined direction when the mechanism is supplied with electric power;

a pump housing provided on a side of the one end portion of the output shaft in the electric motor, having two fluid inlet port regions on a side near the electric motor and on a side away from the electric motor in a longitudinal direction of the output shaft, respectively, and having one fluid discharge port region between the two fluid inlet port regions; and an impeller unit including a pair of impellers having a partition wall concentrically fixed to the one end portion of the output shaft in an inner space of the pump housing, directing to the one fluid discharge port region, spreading outward in a radial direction of the output shaft and partitioning the inner space into a portion near the electric motor and a portion away from the electric motor, and a pair of blade means provided on both sides of the partition wall, respectively, the impeller unit moving fluid on the both sides of the partition wall from inside to outside in the radial direction along the pair of blade means of the pair of impellers by a centrifugal force in the inner space when the impeller unit is rotated by the output shaft of the electric motor in the predetermined direction, and wherein an inner space penetrated by the output shaft is provided in the motor frame of the electric motor;

the motor frame further includes a pump housing communication port region for communicating the inner space with the one fluid inlet port region located at the side near the electric motor in the pump housing, and an external communication port region for communicating the inner space with an outer space of the motor frame on the side farther from the pump housing than the pump housing communication port region in the longitudinal direction of the output, shaft;

the outer space is filled with fluid;

the electric motor includes an axial-flow impeller unit, provided at the output shaft in the inner space, for moving the fluid in the inner space toward the pump housing communication port region along the longitudinal direction of the output shaft by the rotation of the output shaft in the predetermined direction;

the rotation driving mechanism of the electric motor includes a rotor fixed to the output shaft in the inner space of the motor frame, and a stator opposite to the rotor in a radial direction of the output shaft in the motor frame;

a concave portion elongated in the longitudinal direction of the rotor is formed on an outer peripheral surface of the rotor, a circumferential position of the concave portion deviated while extending in the longitudinal direction of the output shaft; and the rotor having the concave portion constitutes the axial-flow impeller unit.

7. A motor-driven pump according to claim 6, wherein a radial bearing rotatably supporting the other end portion of the output shaft is provided in an opposite portion to the pump housing in the motor frame of the electric motor; and another radial bearing rotatably supporting the one end portion of the output shaft is provided in a portion adjacent the pump housing in the motor frame of the electric motor.

8. A motor-driven pump according to claim 6; wherein in the pump housing, the fluid inlet port region on the side away from the electric motor opens outward in the longitudinal direction of the one end portion of the output shaft; and in the pump housing, the fluid inlet port region on the side adjacent the electric motor opens toward the electric motor in the longitudinal direction of the output shaft.

9. A motor-driven pump according to claim 6, wherein the one fluid discharge port region of the pump housing has a plurality of fluid discharge ports; and the plurality of fluid discharge ports are arranged equidistantly in a circumferential direction of the one end portion of the output shaft.

10. A motor-driven pump according to claim 9, wherein extending ends of the plurality of fluid discharge ports are integrated into one end.

11. A motor-driven pump with a plurality of impellers, comprising:

an electric motor including an output shaft, a motor frame rotatably supporting the output shaft while at least one end portion of the output shaft is protruded outward, and a rotation driving mechanism provided in the motor frame and rotating the output shaft in a predetermined direction when the mechanism is supplied with electric power;

a pump housing provided on a side of the one end portion of the output shaft in the electric motor, having two fluid inlet port regions on a side near the electric motor and on a side away from the electric motor in a longitudinal direction of the output shaft, respectively, and having one fluid discharge port region between the two fluid inlet port regions; and an impeller unit including a pair of impellers having a partition wall concentrically fixed to the one end portion of the output shaft in an inner space of the pump housing, directing to the one fluid discharge port region, spreading outward in a radial direction of the output shaft and partitioning the inner space into a portion near the electric motor and a portion away from the electric motor, and a pair of blade means provided on both sides of the partition wall, respectively, the impeller unit moving fluid on the both sides of the partition wall from inside to outside in the radial direction along the pair of blade means of the pair of impellers by a centrifugal force in the inner space when the impeller unit is rotated by the output shaft of the electric motor in the predetermined direction, and wherein an inner space penetrated by the output shaft is provided in the motor frame of the electric motor;

the motor frame further includes a pump housing communication port region for communicating the inner space with the one fluid inlet port region located at the side near the electric motor in the pump housing, and an external communication port region for communicating the inner space with an outer space of the motor frame on the side farther from the pump housing than the pump housing communication port region in the longitudinal direction of the output shaft;

the outer space is filled with fluid;

the electric motor includes an axial-flow impeller unit, provided at the output shaft in the inner space, for moving the fluid in the inner space toward the pump housing communication port region along the longitudinal direction of the output shaft by the rotation of the output shaft in the predetermined direction; and a portion adjacent the pump housing around the output shaft and exposed to the pump housing communication port region in the motor frame is inclined inward in the radial direction of the output shaft as the portion is closer to the partition wall of the impeller unit.

12. A motor-driven pump according to claim 11, wherein a radial bearing rotatably supporting the other end portion of the output shaft is provided in an opposite portion to the pump housing in the motor frame of the electric motor; and another radial bearing rotatably supporting the one end portion of the output shaft is provided in a portion adjacent the pump housing in the motor frame of the electric motor.

13. A motor-driven pump according to claim 11, wherein in the pump housing, the fluid inlet port region on the side away from the electric motor opens outward in the longitudinal direction of the one end portion of the output shaft; and in the pump housing, the fluid inlet port region on the side adjacent the electric motor opens toward the electric motor in the longitudinal direction of the output shaft.

14. A motor-driven pump according to claim 11, wherein the one fluid discharge port region of the pump housing has a plurality of fluid discharge ports; and the plurality of fluid discharge ports are arranged equidistantly in a circumferential direction of the one end portion of the output shaft.

15. A motor-driven pump according to claim 14, wherein extending ends of the plurality of fluid discharge ports are integrated into one end.

16. A motor-driven pump with a plurality of impellers, comprising:

an electric motor including an output shaft, a motor frame rotatably supporting the output shaft while at least one end portion of the output shaft is protruded outward, and a rotation driving mechanism provided in the motor frame and rotating the output shaft in a predetermined direction when the mechanism is supplied with electric power;

a pump housing provided on a side of the one end portion of the output shaft in the electric motor, having two fluid inlet port regions on a side near the electric motor and on a side away from the electric motor in a longitudinal direction of the output shaft, respectively, and having one fluid discharge port region between the two fluid inlet port regions; and an impeller unit including a pair of impellers having a partition wall concentrically fixed to the one end portion of the output shaft in an inner space of the pump housing, directing to the one fluid discharge port region, spreading outward in a radial direction of the output shaft and partitioning the inner space into a portion near the electric motor and a portion away from the electric motor, and a pair of blade means provided on both sides of the partition wall, respectively, the impeller unit moving fluid on the both sides of the partition wall from inside to outside in the radial direction along the pair of blade means of the pair of impellers by a centrifugal force in the inner space when the impeller unit is rotated by the output shaft of the electric motor in the predetermined direction, and wherein an inner space penetrated by the output shaft is provided in the motor frame of the electric motor;

the motor frame further includes a pump housing communication port region for communicating the inner space with the one fluid inlet port region located at the side near the electric motor in the pump housing, and an external communication port region for communicating the inner space with an outer space of the motor frame on the side farther from the pump housing than the pump housing communication port region in the longitudinal direction of the output shaft;

the outer space is filled with fluid;

the electric motor includes an axial-flow impeller unit, provided at the output shaft in the inner space, for moving the fluid in the inner space toward the pump housing communication port region along the longitudinal direction of the output shaft by the rotation of the output shaft in the predetermined direction;

a radial bearing rotatably supporting the other end portion of the output shaft is provided in an opposite portion to the pump housing in the motor frame of the electric motor;

another radial bearing rotatably supporting the one end portion of the output shaft is provided in a portion, located outward from the one end portion in the longitudinal direction of the output shaft, in the pump housing of the electric motor;

the rotation driving mechanism of the electric motor includes a rotor fixed to the output shaft in the inner space of the motor frame, and a stator opposite to the rotor outward in the radial direction of the output shaft in the motor frame;

a concave portion elongated in the longitudinal direction of the rotor is formed on an outer peripheral surface of the rotor, a circumferential position of the concave portion deviated while extending in the longitudinal direction of the output shaft; and the rotor having the concave portion constitutes the axial-flow impeller unit.

17. A motor-driven pump according to claim 16, wherein a portion of the rotor adjacent the pump housing around the output shaft is exposed to the pump housing communication port region of the motor frame, and inclined inward in the radial direction of the output shaft as the portion is closer to the partition wall of the impeller unit.

18. A motor-driven pump according to claim 16, wherein a radial bearing rotatably supporting the other end portion of the output shaft is provided in an opposite portion to the pump housing in the motor frame of the electric motor; and another radial bearing rotatably supporting the one end portion of the output shaft is provided in a portion adjacent the pump housing in the motor frame of the electric motor.

19. A motor-driven pump according to claim 16, wherein in the pump housing, the fluid inlet port region on the side away from the electric motor opens outward in the longitudinal direction of the one end portion of the output shaft; and in the pump housing, the fluid inlet port region on the side adjacent the electric motor opens toward the electric motor in the longitudinal direction of the output shaft.

20. A. motor-driven pump according to claim 16, wherein the one fluid discharge port region of the pump housing has a plurality of fluid discharge ports; and the plurality of fluid discharge ports are arranged equidistantly in a circumferential direction of the one end portion of the output shaft.

21. A motor-driven pump according to claim 20, wherein extending ends of the plurality of fluid discharge ports are integrated into one end.

22. A motor-driven pump with a plurality of impellers, comprising:

an electric motor including an output shaft, a motor frame rotatably supporting the output shaft while at least one end portion of the output shaft is protruded outward, and a rotation driving mechanism provided in the motor frame and rotating the output shaft in a predetermined direction when the mechanism is supplied with electric power;

a pump housing provided on a side of the one end portion of the output shaft in the electric motor, having two fluid inlet port regions on a side near the electric motor and on a side away from the electric motor in a longitudinal direction of the output shaft, respectively, and having one fluid discharge port region between the two fluid inlet port regions; and an impeller unit including an impeller having a partition wall concentrically fixed to the one end portion of the output shaft in an inner space of the pump housing, directing to the one fluid discharge port region, spreading outward in a radial direction of the output shaft and partitioning the inner space into a portion near the electric motor and a portion away from the electric motor, and a blade means provided on a side away from the electric motor on the partition wall, the impeller unit moving fluid on the side away from the electric motor on the partition wall from inside to outside in the radial direction along the blade means of the impeller by a centrifugal force in the inner space when the impeller unit is rotated by the output shaft of the electric motor in the predetermined direction, and wherein an inner space penetrated by the output shaft is provided in the motor frame of the electric motor;

the motor frame further includes a pump housing communication port region for communicating the inner space of the motor frame with the one fluid inlet port region located at the side near the electric motor in the pump housing, and an external communication port region for communicating the inner space of the motor frame with an outer space of the motor frame on the side farther from the pump housing than the pump housing communication port region in the longitudinal direction of the output shaft;

the outer space is filled with fluid;

the electric motor includes an axial-flow impeller unit, provided at the output shaft in the inner space, for moving the fluid in the inner space toward the pump housing communication port region along the longitudinal direction of the output shaft by the rotation of the output shaft in the predetermined direction;

a radial bearing rotatably supporting the other end portion of the output shaft is provided in an opposite portion to the pump housing in the motor frame of the electric motor;

another radial bearing rotatably supporting the one end portion of the output shaft is provided in a portion, located outward from the one end portion of the output shaft in the longitudinal direction in the pump housing;

the rotation driving mechanism of the electric motor includes a rotor fixed to the output shaft in the inner space of the motor frame, and a stator opposite to the rotor in a radial direction of the output shaft in the motor frame;

a concave portion elongated in the longitudinal direction of the rotor is formed on an outer peripheral surface of the rotor, a circumferential position of the concave portion deviated while extending to the longitudinal direction of the output shaft;

the rotor having the concave portion constitutes the axial-flow impeller unit; and a portion of the rotor adjacent the pump housing around the output shaft is exposed to the pump housing communication port region of the motor frame, and is abutted against a side of the electric motor of the partition wall of the axial-flow impeller unit.

23. A motor-driven pump according to claim 22, wherein in the pump housing, the fluid inlet port region on the side away from the electric motor opens outward in the longitudinal direction of the one end portion of the output shaft; and in the pump housing, the fluid inlet port region on the side adjacent the electric motor opens toward the electric motor in the longitudinal direction of the output shaft.

24. A motor-driven pump according to claim 22, wherein the one fluid discharge port region of the pump housing has a plurality of fluid discharge ports; and the plurality of fluid discharge ports are arranged equidistantly in a circumferential direction of the one end portion of the output shaft.

25. A motor-driven pump according to claim 24, wherein extending ends of the plurality of fluid discharge ports are integrated into one end.

26. A motor-driven pump with a plurality of impellers, comprising:

an electric motor including an output shaft, a motor frame rotatably supporting the output shaft while at least one end portion of the output shaft is protruded outward, and a rotation driving mechanism provided in the motor frame and rotating the output shaft in a predetermined direction when the mechanism is supplied with electric power;

a pump housing provided on a side of the one end portion of the output shaft in the electric motor, having two fluid inlet port regions on a side near the electric motor and on a side away from the electric motor in a longitudinal direction of the output shaft, respectively, and having one fluid discharge port region between the two fluid inlet port regions; and an impeller unit including an impeller having a partition wall concentrically fixed to the one end portion of the output shaft in an inner space of the pump housing, directing to the one fluid discharge port region, spreading outward in a radial direction of the output shaft and partitioning the inner space into a portion near the electric motor and a portion away from the electric motor, and a blade means provided on a side away from the electric motor on the partition wall, the impeller unit moving fluid on the side away from the electric motor on the partition wall from inside to outside in the radial direction along the blade means of the impeller by a centrifugal force in the inner space when the impeller unit is rotated by the output shaft of the electric motor in the predetermined direction, and wherein an inner space penetrated by the output shaft is provided in the motor frame of the electric motor;

the motor frame further includes a pump housing communication port region for communicating the inner space of the motor frame with the one fluid inlet port region located at the side near the electric motor in the pump housing, and an external communication port region for communicating the inner space of the motor frame with an outer space of the motor frame on the side farther from the pump housing than the pump housing communication port region in the longitudinal direction of the output shaft;

the outer space is filled with fluid;

the electric motor includes an axial-flow impeller unit, provided at the output shaft in the inner space, for moving the fluid in the inner space toward the pump housing communication port region along the longitudinal direction of the output shaft by the rotation of the output shaft in the predetermined direction;

the rotation driving mechanism of the electric motor includes a rotor fixed to the output shaft in the inner space of the motor frame, and a stator opposite to the rotor in a radial direction of the output shaft in the motor frame;

a concave portion elongated in the longitudinal direction of the rotor is formed on an outer peripheral surface of the rotor, a circumferential position of the concave portion deviated while extending in the longitudinal direction of the output shaft; and the rotor having the concave portion constitutes the axial-flow impeller unit.

27. A motor-driven pump according to claim 26, wherein in the pump housing, the fluid inlet port region on the side away from the electric motor opens outward in the longitudinal direction of the one end portion of the output shaft; and in the pump housing, the fluid inlet port region on the side adjacent the electric motor opens toward the electric motor in the longitudinal direction of the output shaft.

28. A motor-driven pump according to claim 26, wherein the one fluid discharge port region of the pump housing has a plurality of fluid discharge ports; and the plurality of fluid discharge ports are arranged equidistantly in a circumferential direction of the one end portion of the output shaft.

29. A motor-driven pump according to claim 28, wherein extending ends of the plurality of fluid discharge ports are integrated into one end.

* * * * *